US010920486B2

(12) United States Patent
Lin

(10) Patent No.: US 10,920,486 B2
(45) Date of Patent: Feb. 16, 2021

(54) BEAD CHAIN SAFETY SYSTEM FOR ROLLER BLIND

(71) Applicant: LIN GWO TSAIR ENTERPRISE CO., LTD., Tainan (TW)

(72) Inventor: Yu-Hao Lin, Tainan (TW)

(73) Assignee: Lin Gwo Tsair Enterprise Co., Ltd., Tainan (TW)

( * ) Notice: Subject to any disclaimer, the term of this patent is extended or adjusted under 35 U.S.C. 154(b) by 229 days.

(21) Appl. No.: 16/118,713

(22) Filed: Aug. 31, 2018

(65) Prior Publication Data

US 2020/0071994 A1 Mar. 5, 2020

(51) Int. Cl.
*E06B 9/326* (2006.01)
*E06B 9/42* (2006.01)

(52) U.S. Cl.
CPC ..... *E06B 9/326* (2013.01); *E06B 9/42* (2013.01); *E06B 2009/3265* (2013.01)

(58) Field of Classification Search
CPC .. E06B 2009/3265; E06B 9/326; E06B 9/322; E06B 9/42
USPC ..... 160/319, 321
See application file for complete search history.

(56) References Cited

U.S. PATENT DOCUMENTS

| | | | | |
|---|---|---|---|---|
| 8,336,598 | B1 * | 12/2012 | Chang | E06B 9/56 160/177 V |
| 9,957,752 | B2 * | 5/2018 | Bohlen | E06B 9/50 |
| 10,113,594 | B2 * | 10/2018 | Cheng | E06B 9/326 |
| 10,626,670 | B2 * | 4/2020 | Cheng | E06B 9/82 |
| 2003/0145959 | A1 * | 8/2003 | Bohlen | E06B 9/322 160/170 |
| 2012/0017399 | A1 * | 1/2012 | Huang | E06B 9/326 24/115 F |
| 2018/0179816 | A1 * | 6/2018 | Cheng | E06B 9/50 |
| 2019/0128059 | A1 * | 5/2019 | Cheng | E06B 9/78 |
| 2019/0211622 | A1 * | 7/2019 | Kao | E06B 9/78 |

* cited by examiner

*Primary Examiner* — Daniel P Cahn
*Assistant Examiner* — Jeremy C Ramsey
(74) *Attorney, Agent, or Firm* — Rosenberg, Klein & Lee

(57) ABSTRACT

A bead chain safety system for roller blinds is revealed. The system includes a fixing base, an assembly base, a rotary disc, a first transmission member, and an elastic member. When a child entangled pulls a bead chain, the first transmission member is retracted into a cavity of the rotary disc and both the rotary disc and the bead chain are released from a rotary-disc mounting space between the fixing base and the assembly base. In order to put the rotary disc and other parts back, first the elastic member and the first transmission member are mounted into the cavity in turn. Then the rotary disc and the bead chain are set into the rotary-disc mounting space. The first transmission member pushed back by the elastic member is locked with and positioned by a second transmission member. Thus the bead chain and other parts are mounted again easily.

13 Claims, 5 Drawing Sheets

BEAD CHAIN SAFETY SYSTEM FOR ROLLER BLIND

BACKGROUND OF THE INVENTION

Field of the Invention

The present invention relates to a safety system for roller blinds, especially to a bead chain safety system for roller blinds that not only prevents children's deaths caused by entanglement in a bead chain but also allows the assembly of a rotary disc into a rotary-disc mounting space more easily and conveniently.

Description of Related Art

Refer to Taiwanese Pat. Pub. No. M530617 U, a safety device for roller blind bead chain is revealed. A bead chain in a rotary disc is easily released when kid's neck got caught in the bead chain and the bead chain is pulled. Thus the risk of strangulation is minimized. However, curtain rods or rails are usually arranged above windows or along the edge of the room. A base provided with a pivotally-connected cover and installed at the end of the curtain rod is set on the wall and adjacent to another wall of the room. Thus the cover may be in contact with the adjacent wall while being pushed by the bead chain released from the rotary disc. The angle of the cover being opened is limited. It's difficult for users to put the bead chain back owing to the limited angle of the cover being opened and the high position of the base on the end of the curtain rod.

SUMMARY OF THE INVENTION

Therefore it is a primary object of the present invention to provide a bead chain safety system for roller blinds in which a rotary disc is released while a force being applied to a bead chain so as to prevent children's injuries or deaths caused by entanglement in the bead chain. Moreover, the rotary disc can be mounted into a rotary-disc mounting space again easily conveniently.

In order to achieve the above object, a safety release device for roller blinds according to the present invention includes a fixing base, an assembly base, a rotary disc mounted in a rotary-disc mounting space formed between the fixing base and the assembly base, a first transmission member mounted in a cavity of the rotary disc, and an elastic member mounted in the cavity of the rotary disc. Thereby a component of a force applied to a bead chain pushes the first transmission member toward the rotary disc under guidance of a conical head of the first transmission member mounted in a tapered slot of a second transmission member in the assembly base when a child got caught by the neck in the bead chain pulls the bead chain. Thus the first transmission member is retracted into the cavity of the rotary disc. The rotary disc, the bead chain and other parts are released from the rotary-disc mounting space. The risk of strangulation is eliminated. In order to put the rotary disc and other parts back, first the elastic member and the first transmission member are mounted into the cavity of the rotary disc in turn. Then the rotary disc and the bead chain are set into the rotary-disc mounting space. Next the first transmission member is pushed back by the elastic member to be locked with and positioned by the second transmission member. Thus the rotary disc and the bead chain are mounted into the rotary-disc mounting space again easily and conveniently.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
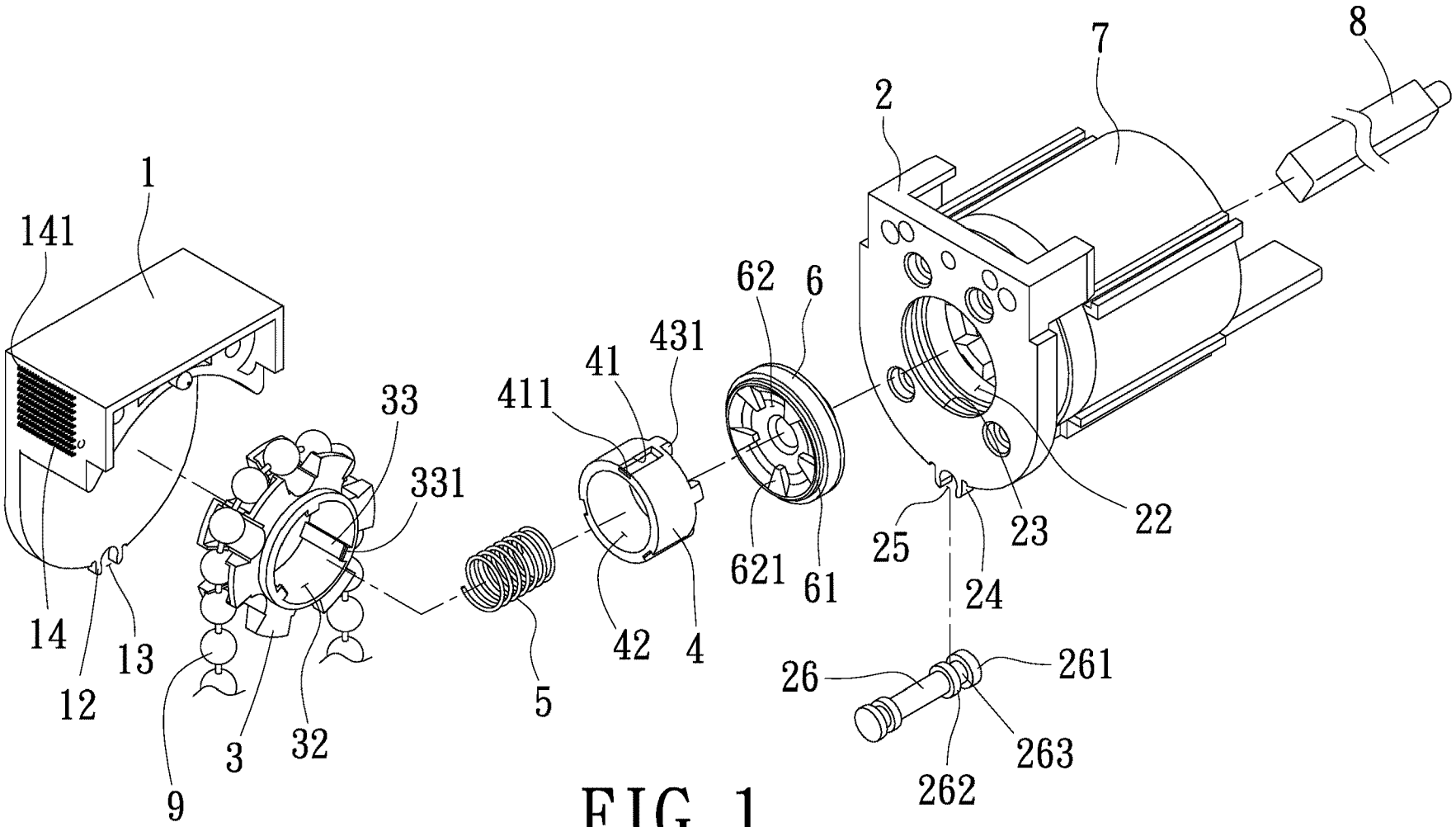
FIG. 1 is an explosive view of an embodiment according to the present invention.
Figure 2:
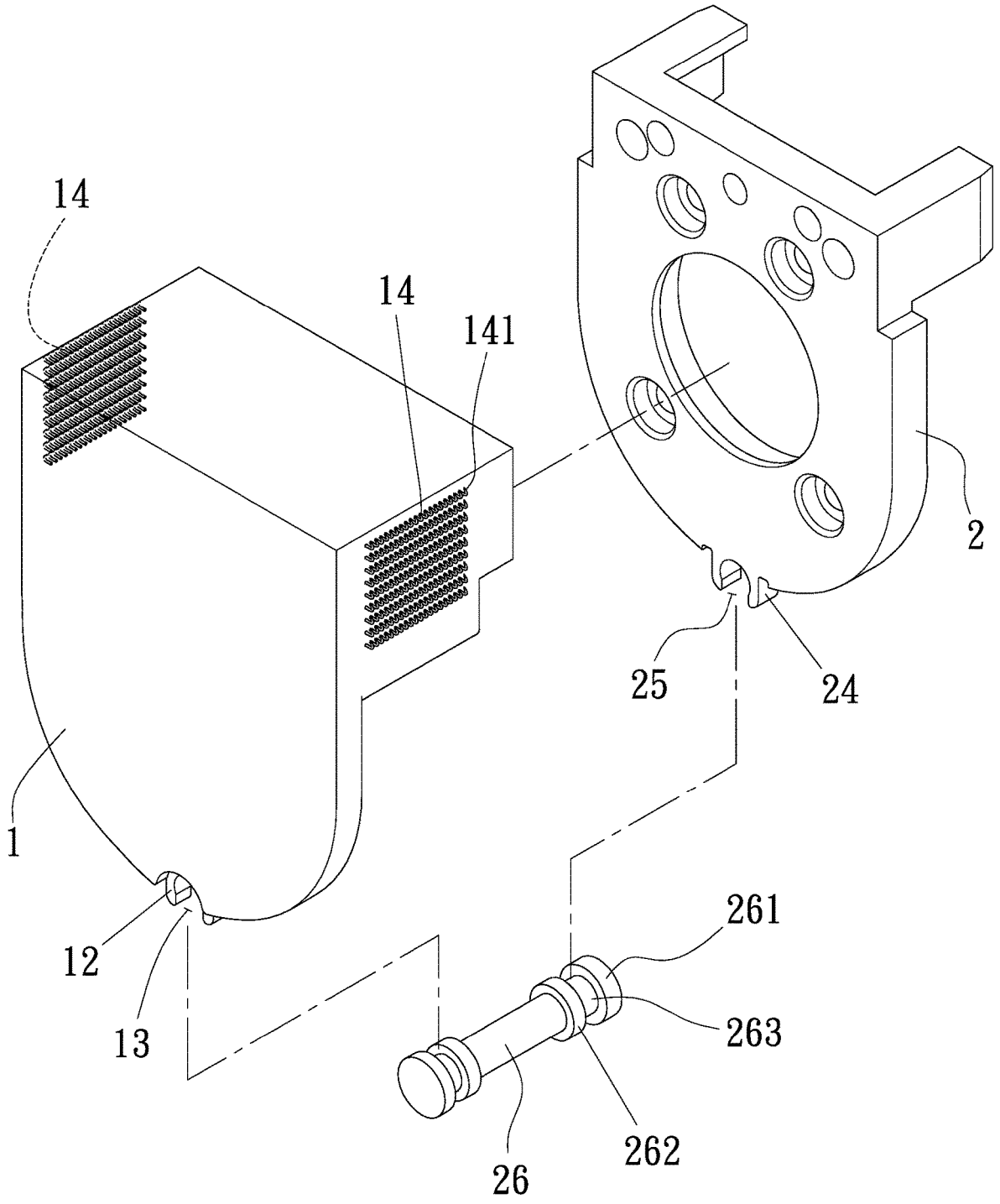
FIG. 2 is a partial explosive view of an embodiment according to the present invention.
Figure 3:
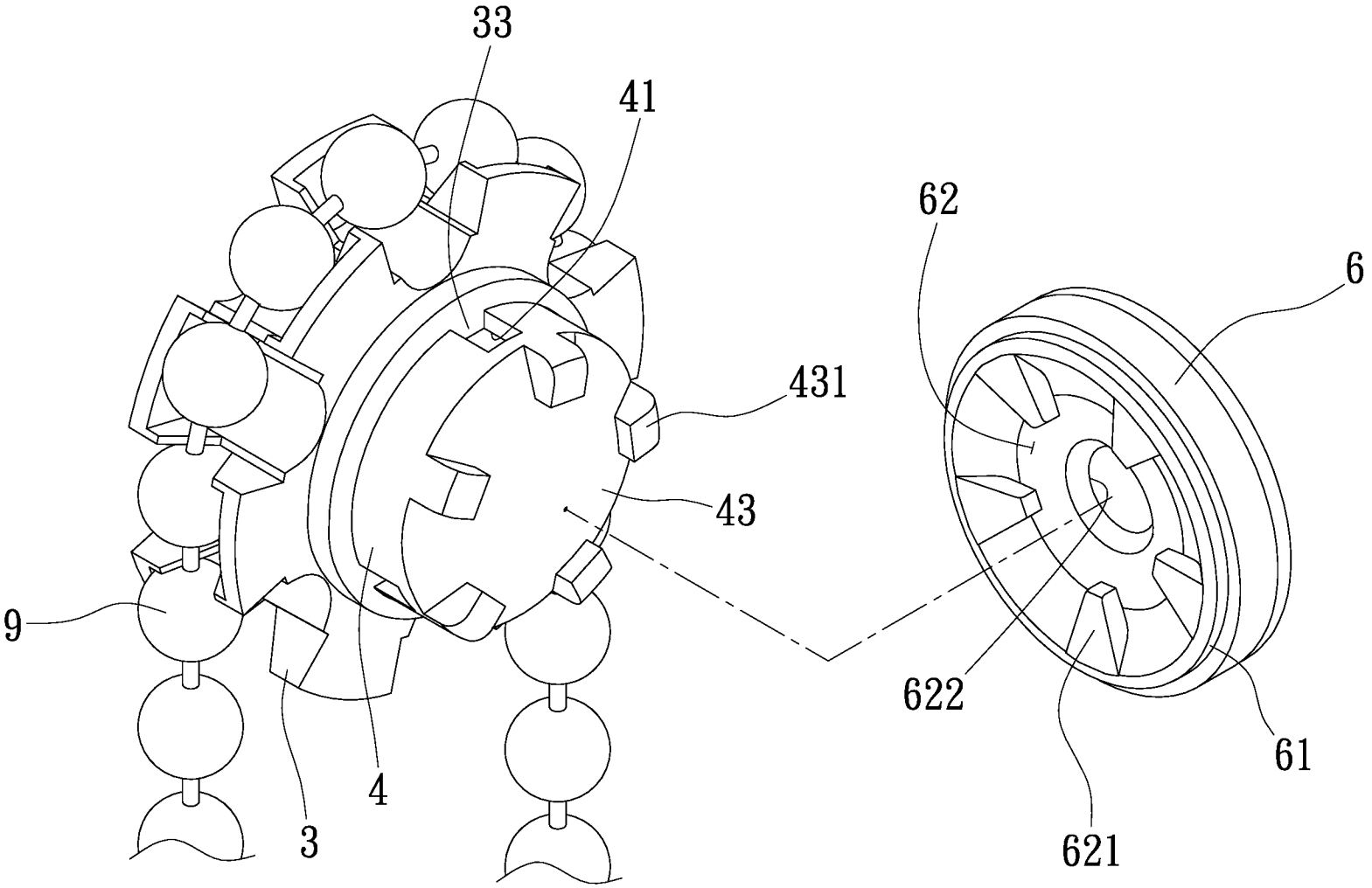
FIG. 3 is another partial explosive view of an embodiment according to the present invention.

Refer to FIG. 1, FIG. 2 and FIG. 3, a bead chain safety system for roller blinds according to the present invention mainly includes a fixing base 1, an assembly base 2, a rotary disc 3, a first transmission member 4, an elastic member 5, a second transmission member 6, a sleeve 7 and a transmission rod 8.

Figure 4:
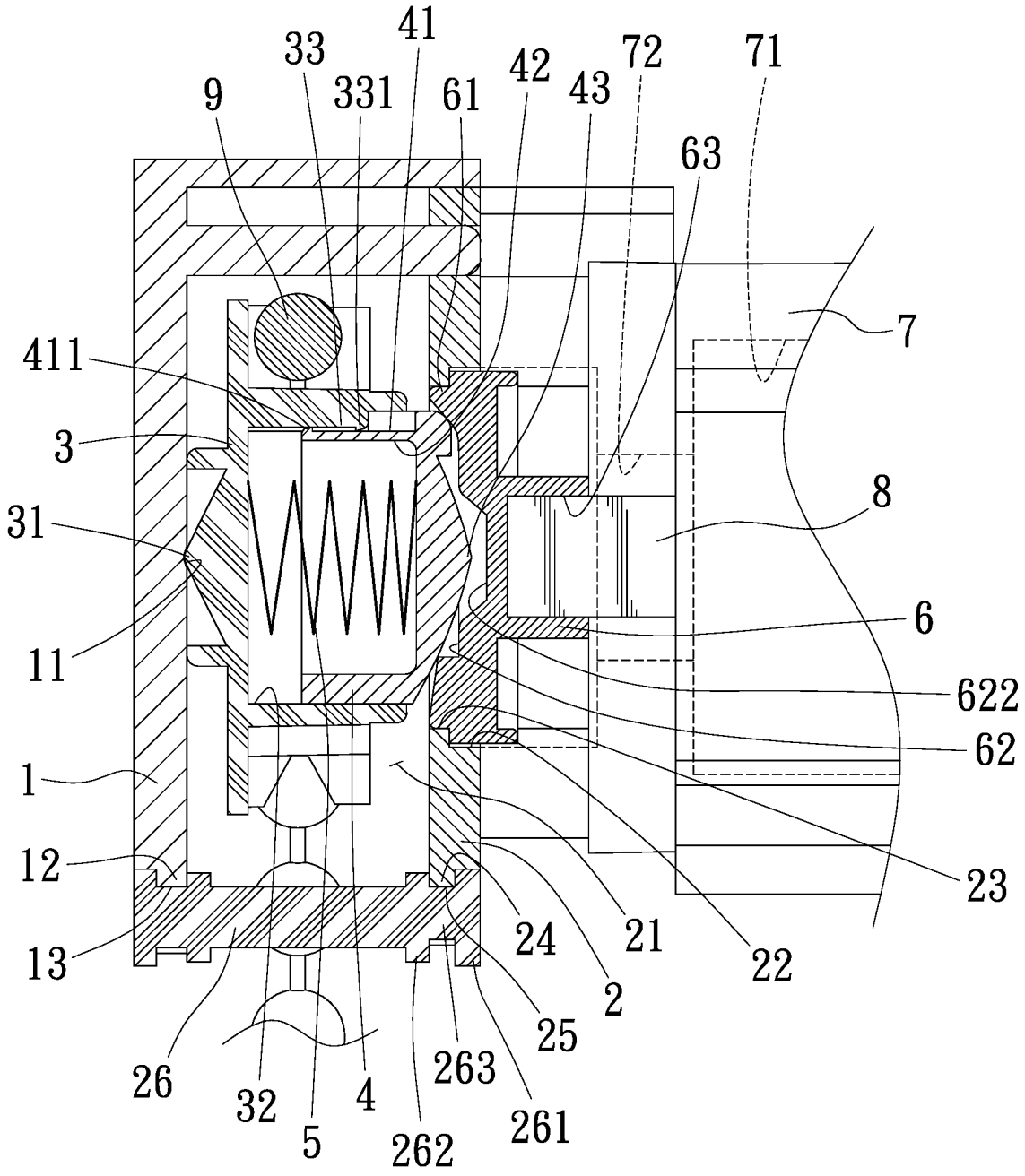
FIG. 4 is a sectional view of an embodiment according to the present invention.

The fixing base 1 having a first end and a second end opposite to the first end consists of a conical recess 11, two projecting pieces 12, a mounting slot 13 and at least one blind-fabric fixing part 14. As shown in FIG. 4, the conical recess 11 is formed on the second end of the fixing base 1. The two projecting pieces 12 are set on an edge of a bottom side of the fixing base 1 while the mounting slot 13 is formed therebetween. The blind-fabric fixing part 14 is formed by a plurality of hooks 141 and arranged at one side of the fixing base 1. In a preferred embodiment, two blind-fabric fixing parts 14 are disposed on opposite sides of the fixing base 1 respectively.

The assembly base 2 also includes a first end and a second end opposite to the first end. The first end of the assembly base 2 is connected to the second end of the fixing base 1 so that a rotary-disc mounting space 21 is formed between the assembly base 2 and the fixing base 1. The assembly base 2 further includes a first cavity 22, a through hole 23, two projecting pieces 24, a mounting slot 25, and a positioning pin 26. The first cavity 22 is formed on the second end of the assembly base 2 while the through hole 23 penetrating from the second end to the first end of the assembly base 2 is located at the center of the bottom of the cavity 22 and is communicating with the rotary-disc mounting space 21. The two projecting pieces 24 are arranged at an edge of a bottom side of the assembly base 2 while the mounting slot 25 is formed therebetween. Each end of the positioning pin 26 is provided with a first stopping block 261 and a second stopping block 262 spaced from and adjacent to the first stopping block 261. Thus a mounting segment 263 is formed between the first stopping block 261 and the second stopping block 262. The mounting segments 263 on two ends of the positioning pin 26 are mounted to the mounting slot 13 between the projecting pieces 12 of the fixing base 1 and the mounting slot 25 between the projecting pieces 24 of the assembly base 2 respectively. The first stopping block 261 and the second stopping block 262 on one end of the positioning pin 26 are pressed onto and positioned by two opposite surfaces of the projecting pieces 12 of the fixing base 1 respectively while the first stopping block 261 and the second stopping block 262 on the other end of the positioning pin 26 are pressed onto and positioned by two opposite surfaces of the projecting pieces 24 of the assembly base 2 respectively.

The rotary disc 3 is mounted in the rotary-disc mounting space 21 and having a first end and a second end opposite to each other. The rotary disc 3 consists of a conical projection 31 located at the center of the first end thereof, a second cavity 32 formed on the center of the second end thereof, and a plurality of guide bars 33 spaced apart and arranged at the wall of the second cavity 32 lengthwise thereof. One end of the guide bar 33 located at an opening of the second cavity 32 is provided with a first locking edge 331. The conical projection 31 is connected to and positioned by the conical recess 11 on the second end of the fixing base 1.

The first transmission member 4 with a first end and a second end opposite to the first end is mounted in the second cavity 32 of the rotary disc 3 and the second end thereof is protruding from the second cavity 32 of the rotary disc 3. The first transmission member 4 includes a plurality of guide grooves 41 spaced apart and arranged around the wall thereof, a third cavity 42 at the center of the first end thereof, and a conical head 43 formed on the second end thereof. The guide grooves 41 are extending from the first end to the second end of the first transmission member 4 and the guide bars 33 on the second cavity 32 are mounted into the guide grooves 41 respectively. One end of the guide grooves 41 located at the first end of the first transmission member 4 is provided with a second locking rim 411. The second locking rim 411 on the guide groove 41 of the first transmission member 4 is locked with and positioned by the first locking edge 331 on the guide bar 33 of the rotary disc 3. A plurality of first ribs 431 is equally spaced around the conical head 43 of the first transmission member 4.

The elastic member 5 that is a compression spring is mounted in the second cavity 32 of the rotary disc 3 and the third cavity 42 of the first transmission member 4. Two ends of the elastic member 5 abut against the bottom of the second cavity 32 of the rotary disc 3 and the bottom of the third cavity 42 at the first end of the first transmission member 4 respectively for positioning.

The second transmission member 6 is mounted in the first cavity 22 of the assembly base 2 and having a first end and a second end opposite to each other. A protruding connection part 61 is disposed on the first end of the second transmission member 6 and a tapered slot 62 is formed on the connection part 61 while a polygonal fitting recess 63 is arranged at the second end of the second transmission member 6. The connection part 61 is set into the through hole 23 of the assembly base 2 so that the first end of the second transmission member 6 is abutting against and positioned by the bottom of the first cavity 22 of the assembly base 2. A plurality of second ribs 621 are equally spaced around a wall of the tapered slot 62 and a concave part 622 is set on the center of the bottom of the tapered slot 62. The conical head 43 of the first transmission member 4 is mounted into the tapered slot 62 of the second transmission member 6 and the first ribs 431 on the conical head 43 are locked with and positioned by the second ribs 621 on the tapered slot 62 while the end portion of the conical head 43 is located in the concave part 622 on the bottom of the tapered slot 62. The polygonal fitting recess 63 can be rectangular.

The sleeve 7 also includes a first end and a second end opposite to each other. The first end of the sleeve 7 is connected to the second end of the assembly base 2. A fourth cavity 71 is formed at the center of the second end of the sleeve 7 while an insertion hole 72 that passes through the sleeve 7 is set on the center of the bottom of the fourth cavity 71 and is corresponding to the fitting recess 63 of the second transmission member 6.

The transmission rod 8 is polygonal such as rectangular and having a first end and a second end opposite to each other. The first end of the transmission rod 8 is passed through the insertion hole 72 of the fourth cavity 71 of the sleeve 7 to be connected to the fitting recess 63 of the second transmission member 6 correspondingly.

While being assembled, the second end of the fixing base 1 is connected to the first end of the assembly base 2 so that the rotary-disc mounting space 21 is formed between the assembly base 2 and the fixing base 1. Then the second transmission member 6 is mounted into the through hole 23 of the assembly base 2 and the first end of the sleeve 7 is connected to the second end of the assembly base 2. The first end of the transmission rod 8 is passed through the insertion hole 72 of the fourth cavity 71 of the sleeve 7 to be connected to the fitting recess 63 of the second transmission member 6. Next the elastic member 5 and the first transmission member 4 are placed into the second cavity 32 of the rotary disc 3 in turn. Thus the two ends of the elastic member 5 abut against the bottom of the second cavity 32 of the rotary disc 3 and the bottom of the third cavity 42 of the first transmission member 4 respectively. The guide grooves 41 around the wall of the first transmission member 4 and the guide bars 33 on the second cavity 32 of the rotary disc 3 are engaged with each other correspondingly while the first locking edge 331 on the end of the guide bar 33 and the second locking rim 411 of the guide groove 41 are locked with and positioned by each other. Thus the rotary disc 3, the first transmission member 4 and the elastic member 5 are assembled and connected securely. Then a bead chain 9 is set around the rotary disc 3 and the first transmission member 4 is pressed onto the rotary disc 3 to be retracted into the second cavity 32 of the rotary disc 3 for compressing the elastic member 5 in the second cavity 32. Next the assembly of the rotary disc 3, the first transmission member 4, with the elastic member 5, and the bead chain 9 on the rotary disc 3 are mounted into the rotary-disc mounting space 21. The elastic member 5 goes back to the original state for pushing the first transmission member 4 further into the through hole 23 of the assembly base 2 when the first transmission member 4 reaches the through hole 23 of the assembly base 2, without being limited in the rotary-disc mounting space 21. Thus the conical head 43 of the first transmission member 4 is mounted into the tapered slot 62 of the second transmission member 6 correspondingly and the first ribs 431 on the conical head 43 are locked with and positioned by the second ribs 621 on the tapered slot 62. Then the mounting segments 263 on two ends of the positioning pin 26 are mounted to the mounting slots 13, 25 between the projecting pieces 12, 24 of the fixing base 1 and the assembly base 2 respectively. Thereby the rotary-disc mounting space 21 will not be compressed and deformed owing to the projecting pieces 12, 24 on the bottom of the fixing base 1 and the assembly base 2 being stopped and positioned by the positioning pin 26 when the fixing base 1 and the assembly base 2 are pressed by an external force during transportation or storage. At the moment, the assembly of the bead chain safety system has been completed.

While in use, the first transmission member 4 connected to the rotary disc 3 is driven to rotate through the rotary disc 3 once the bead chain 9 is pulled. By the design of the first ribs 431 locked with and positioned by the second ribs 621 on the tapered slot 62 of the second transmission member 6, the conical head 43 of the first transmission member 4 further drives the second transmission member 6 to rotate. During rotation of the second transmission member 6, the transmission rod 8 connected to the second transmission member 6 also rotates. Thus blind fabric on a blind tube connected to the second end of the transmission rod 8 is driven to be rolled up and down.

Figure 5:
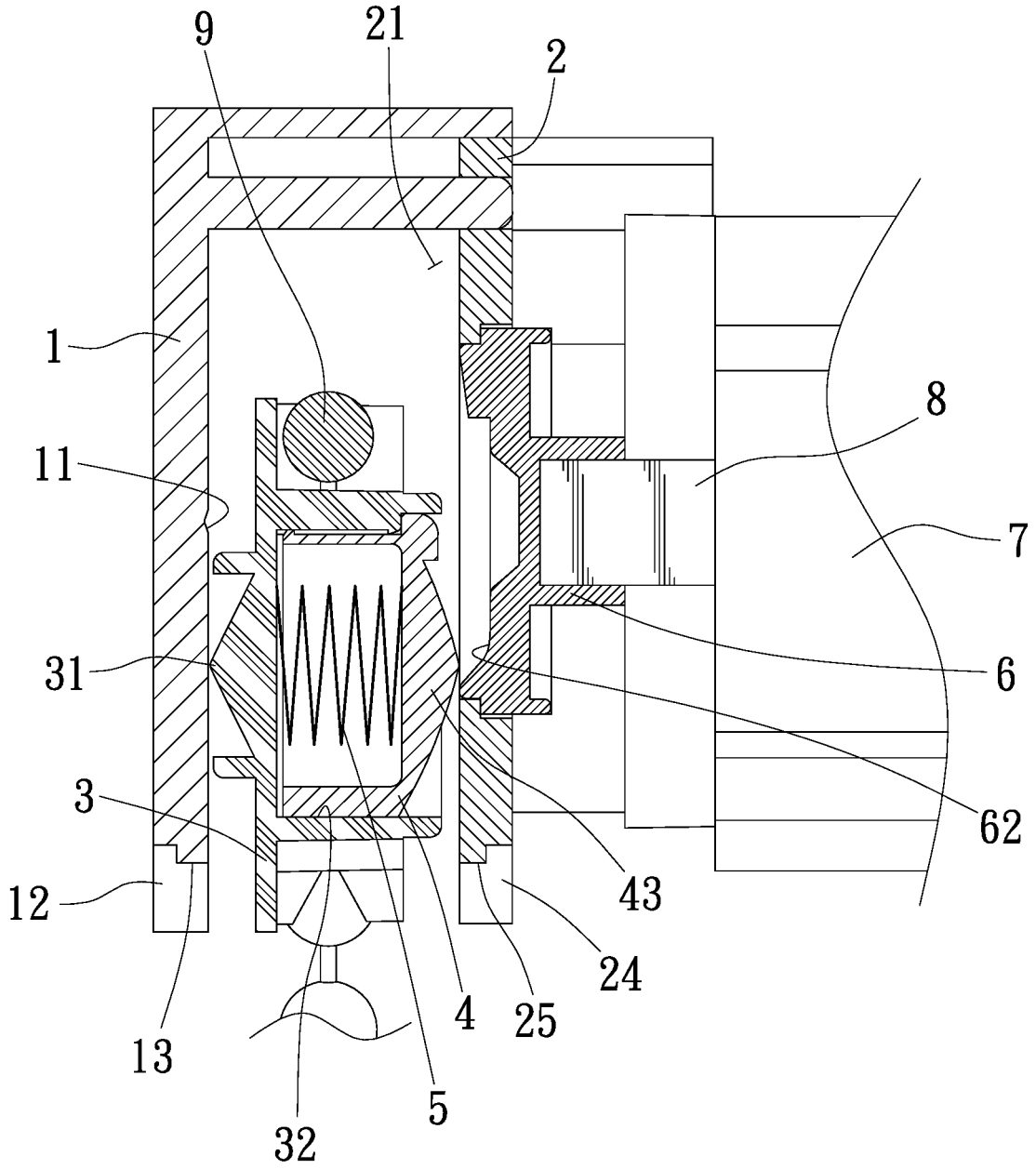
FIG. 5 is a sectional view of an embodiment showing releasing of a rotary disc according to the present invention.

A kid applies a force to the bead chain 9 for pulling the bead chain 9 when he is playing the bead chain 9 and becoming entangled by the neck in the bead chain 9. As shown in FIG. 5, a component of the force applied to the bead chain 9 pushes the first transmission member 4 toward the rotary disc 3 under guidance of the conical head 43 of the first transmission member 4 mounted in the tapered slot 62 of the second transmission member 6. Thus the first transmission member 4 is retracted into the second cavity 32 of the rotary disc 3 and the conical head 43 of the first transmission member 4 is released from the positioned state, separated from the tapered slot 62 of the second transmission member 6. Moreover, another component of the force applied pushes the rotary disc 3 toward the first transmission member 4 under guidance of the conical projection 31 connected to the conical recess 11 of the fixing base 1. Thus the rotary disc 3 is moved a bit toward the first transmission member 4 and the conical projection 31 is released from the conical recess 11. Thereby the rotary disc 3, the first transmission member 4, the elastic member 5 and the bead chain 9 are all released from the rotary-disc mounting space 21 smoothly if the kid continues to pull the bead chain 9. Therefore the risk of strangulation to kids from the bead chain 9 can be eliminated. When the rotary disc 3 and other parts are pulled to pop out the rotary-disc mounting space 21, they will hit the positioning pin 26 so that the positioning pin 26 is also pulled and released from the fixing base 1 and the assembly base 2.

When the user intends to put the rotary disc 3, the first transmission member 4, the elastic member 5 and the bead chain 9 back together, first the elastic member 5 and the first transmission member 4 are mounted into the second cavity 32 of the rotary disc 3 in turn. The guide bars 33 on the second cavity 32 of the rotary disc 3 are set into the guide grooves 41 of the first transmission member 4 respectively. Thus the assembly of the rotary disc 3, the first transmission member 4 and the elastic member 5 is complete. Then the bead chain 9 is arranged around the rotary disc 3 and the first transmission member 4 is pressed onto the rotary disc 3 to be retracted into the second cavity 32 of the rotary disc 3. Next the assembly of the rotary disc 3, the first transmission member 4, and the elastic member 5 as well as the bead chain 9 is mounted into the rotary-disc mounting space 21. When the first transmission member 4 reaches the through hole 23 of the assembly base 2, the first transmission member 4 is pushed back to the original position by the elastic member 5. Thus the conical head 43 of the first transmission member 4 is mounted into the tapered slot 62 of the second transmission member 6 and the first ribs 431 on the conical head 43 are locked with and positioned by the second ribs 621 on the tapered slot 62. Thereby the rotary disc 3, the first transmission member 4, the elastic member 5 and the bead chain 9 are all mounted into the rotary-disc mounting space 21 between the fixing base 1 and the assembly base 2 again easily. Furthermore, the user can choose to mount the positioning pin 26 into the mounting slot 13/the mounting slot 25 or not since the fixing base 1 and the assembly base 2 have been arranged at a higher position, unable to be compressed by an external force easily like the condition happened during transportation or storage.

In addition, a lateral side of the blind fabric is attached to and fixed on the fixing base 1 by the plurality of hooks 141 of the blind-fabric fixing part 14 on the side of the fixing base 1 being caught in a looped surface of a hook-and-loop fastener preset on an inner surface of the blind fabric. Thereby no sunlight will flow into the room through gaps generated due to curved or wavy blind fabric.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A bead chain safety system for roller blinds comprising:

a fixing base having a first side, and a second side that is opposite to the first side, the second side having a recess formed therein;

an assembly base provided with a first end and a second end opposite to each other, the first end of the assembly base being connected to the second side of the fixing base and defining a rotary-disc mounting space therebetween, the assembly base having a first cavity formed in the second end thereof, and a through hole formed centrally in a bottom of the first cavity and extending through the second end of the assembly base to provide open communication between the first cavity and the rotary-disc mounting space;

a rotary disc having opposing closed and open ends being mounted in the rotary-disc mounting space, the closed end having a projection at a center thereof and the open end having a second cavity formed centrally therein; the projection is being disposed in the recess of the second side of the fixing base and supported thereby;

a first transmission member mounted in the second cavity of the rotary disc; the first transmission member having a conical head protruding from the second cavity of the rotary disc and an opposing open end disposed in the second cavity, the conical head having a plurality of first ribs disposed thereon;

a spring mounted in the second cavity of the rotary disc and having two ends respectively abutting against a bottom of the second cavity of the rotary disc and the open end of the first transmission member for positioning; and a second transmission member mounted in the first cavity of the assembly base and including a tapered slot arranged on one side thereof and a plurality of second ribs spaced around a wall of the tapered slot; the tapered slot being disposed in correspondence with the through hole of the assembly base and the conical head of the first transmission member being mounted in the tapered slot of the second transmission member and the first ribs on the conical head are locked with and positioned by the second ribs.

2. The system as claimed in claim 1, wherein the rotary disc has a plurality of guide bars disposed lengthwise with respect the rotary disc on a wall of the second cavity in spaced apart relationship; the first transmission member having a plurality of guide grooves disposed around a wall thereof in spaced relationship and extending from the open end to the conical head of the first transmission member; the guide bars on the wall of the second cavity of the rotary disc are respectively engaged in the guide grooves of the first transmission member.

3. The system as claimed in claim 2, wherein an end of each of the plurality of guide bars located at an opening of the second cavity of the rotary disc is provided with a locking edge, and an end of each of the plurality of guide grooves located at the open end of the first transmission member is provided with a locking rim; the locking edge on each guide bar of the rotary disc and the locking rim of a corresponding one of the plurality of guide grooves of the first transmission member are locked with and positioned by each other.

4. The system as claimed in claim 1, wherein a third cavity is arranged at a center of the open end of the first transmission member; the spring is mounted in the second cavity of the rotary disc and the third cavity of the first transmission member while two ends thereof are abutting against and positioned by the bottom of the second cavity of the rotary disc and a bottom of the third cavity.

5. The system as claimed in claim 1, wherein a protruding connection part is disposed on the one side of the second transmission member and the tapered slot is arranged at the connection part; the connection part is mounted into the through hole of the assembly base.

6. The system as claimed in claim 1, wherein a concave part is set on a center of a bottom of the tapered slot; an end portion of the conical head of the first transmission member is located in the concave part of the tapered slot.

7. The system as claimed in claim 1, wherein a polygonal fitting recess is arranged at a side of the second transmission member opposite to the one side thereof.

8. The system as claimed in claim 7, wherein the system further includes a sleeve having one end connected to the second end of the assembly base and an opposing end with a fourth cavity formed at a center thereof, the sleeve having an insertion hole at a center of a bottom of the fourth cavity and passing through the sleeve, the insertion hole being disposed in correspondence with the fitting recess of the second transmission member.

9. The system as claimed in claim 8, wherein the system further includes a transmission rod that is polygonal and having one end passing through the insertion hole of the sleeve and connected to the fitting recess of the second transmission member.

10. The system as claimed in claim 1, wherein the recess on the second side of the fixing base is conical and the projection on the closed end of the rotary disc is conical so that the conical projection of the rotary disc is connected to and positioned by the conical recess of the fixing base.

11. The system as claimed in claim 1, wherein each of a bottom side of the fixing base and an edge of a bottom side of the assembly base respectively have two projecting pieces extending therefrom and a mounting slot is respectively formed between the two projecting pieces of the fixing base and the two projecting pieces of the assembly base; a positioning pin includes two ends each of which is composed of a first stopping block, a second stopping block spaced from and adjacent to the first stopping block, and a mounting segment formed between the first stopping block and the second stopping block; the mounting segments on two ends of the positioning pin are respectively mounted to the mounting slot between the projecting pieces of the fixing base and the mounting slot between the projecting pieces of the assembly base; the first stopping block and the second stopping block on one of the two ends of the positioning pin are pressed onto and respectively positioned by two opposite surfaces of the projecting pieces of the fixing base while the first stopping block and the second stopping block on the other end of the positioning pin are pressed onto and respectively positioned by two opposite surfaces of the projecting pieces of the assembly base.

12. The system as claimed in claim 1, wherein a blind-fabric fixing part is disposed on at least one side of the fixing base.

13. The system as claimed in claim 12, wherein the blind-fabric fixing part is formed by a plurality of hooks.

* * * * *